United States Patent [19]

Glass

[11] Patent Number: 4,577,358

[45] Date of Patent: Mar. 25, 1986

[54] BEAN BAG BODY SUPPORT

[76] Inventor: Ted A. Glass, 3666 N. Miller Rd., Scottsdale, Ariz. 85251

[21] Appl. No.: 760,495

[22] Filed: Jul. 30, 1985

Related U.S. Application Data

[63] Continuation of Ser. No. 619,370, Jun. 11, 1984, abandoned.

[51] Int. Cl.[4] ..... A47C 27/10

[52] U.S. Cl. ..... 5/455; 5/449; 269/328

[58] Field of Search ..... 269/266, 328; 5/449, 5/450, 455, 462, 464, 441

[56] References Cited

U.S. PATENT DOCUMENTS

| | | | |
|---|---|---|---|
| 3,242,511 | 3/1966 | Fultz et al. | 5/449 |
| 3,629,882 | 12/1971 | Thorne | 5/449 |
| 4,281,873 | 8/1981 | Holland | 5/449 |
| 4,425,676 | 1/1984 | Crane | 5/450 |

*Primary Examiner*—Frederick R. Schmidt
*Assistant Examiner*—Judy J. Hartman
*Attorney, Agent, or Firm*—M. David Shapiro

[57] ABSTRACT

The invention comprises an improved bean bag structure with a pattern of internal cups and fasteners installed on or in the bag to control its shape against the forces of gravity and in the face of external forces applied thereto. The bag is useful for providing comfort and stabilization for medical and dental patients and more generally for any comfort seeking persons.

2 Claims, 8 Drawing Figures

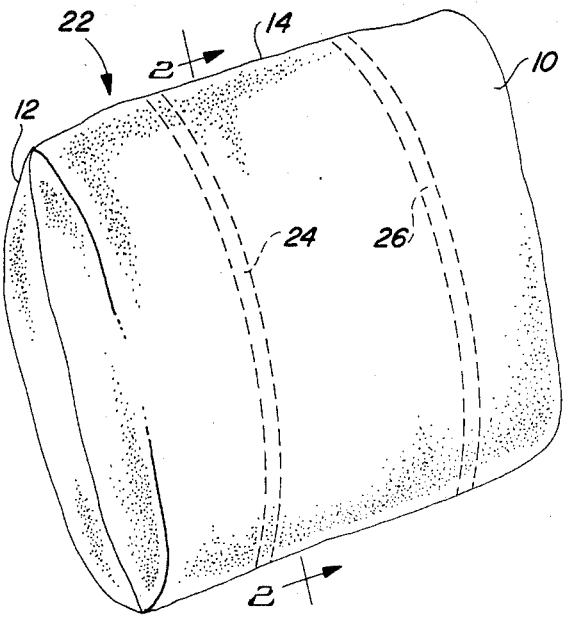
FIG. 1
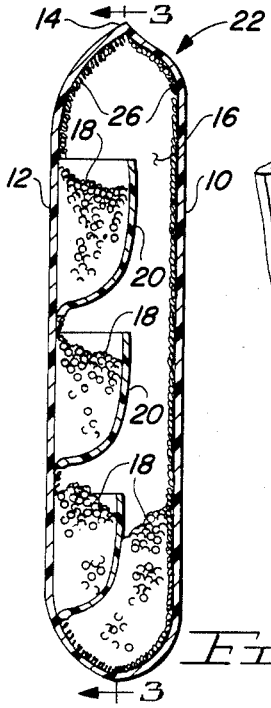
FIG. 2
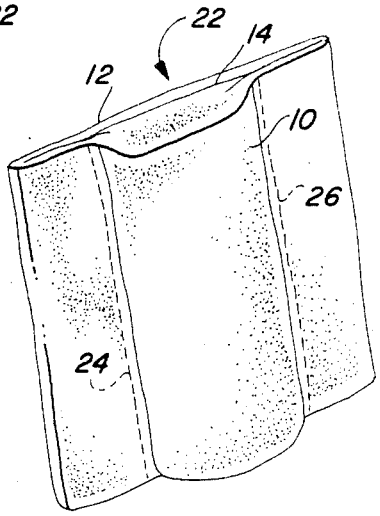
FIG. 4
FIG. 3
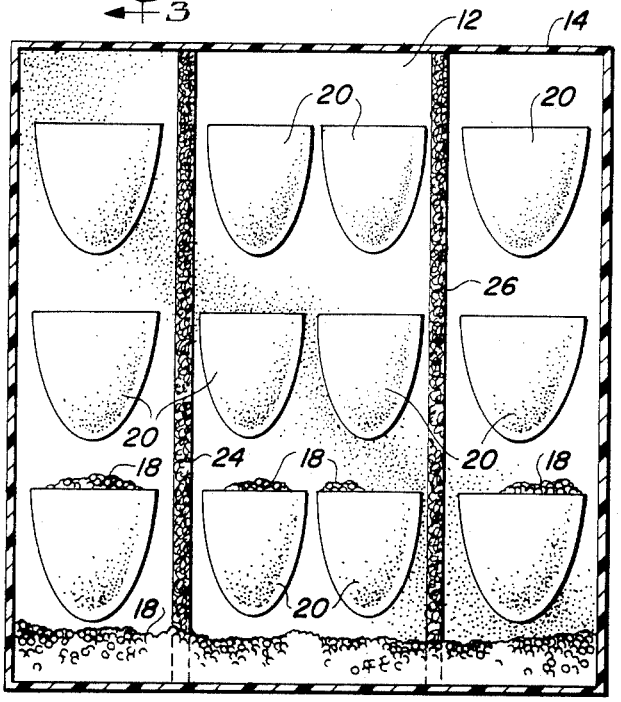
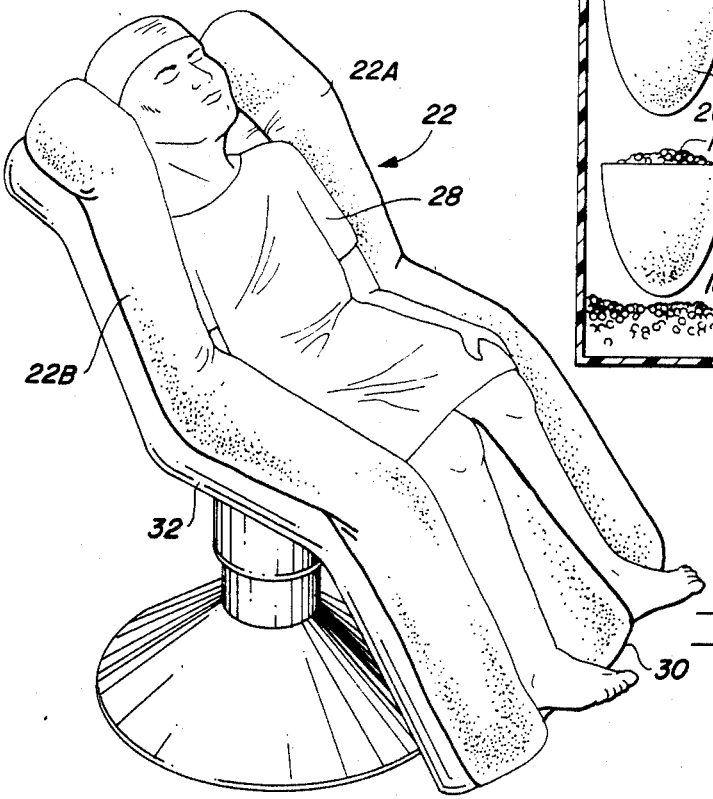
FIG. 5

BEAN BAG BODY SUPPORT

This is a continuation of application Ser. No. 619,370, filed on June 11, 1984, now abandoned.

FIELD OF THE INVENTION

The invention relates to "bean bag" structures which are adjustable in size and shape to better fit various human body part shapes and sizes. The invention is operable in either horizontal or inclined orientation.

BACKGROUND OF THE INVENTION

It is well known that various dental and medical procedures require physical stabilization of applicable portions of the human body. Furthermore, closely fitting a support structure to certain portions of the body is well known and the technique is frequently utilized to provide a high degree of comfort to that portion of the body which is so supported.

The known prior art supports this representation. U.S. Pat. No. 1,893,548 (Hardy) teaches the use of baffles to discourage movement of down filler in a sleeping bag; U.S. Pat. No. 2,464,380 (Daiber) teaches connecting of outer membranes of an insulated garment to prevent movement of the filler material therebetween; U.S. Pat. No. 4,281,873 (Holland) uses "zip" of "press studs" to close off a predetermined volume in a "bean bag" furniture structure to restrict movement of the filler material within that volume—the technique taught there is to create either a bed or a chair with the same filler material being moved from one envelope structure to another.

As understood, French Pat. No. 2,464,066 (Pelosse) appears to teach the use of a bag enclosed filler which becomes relatively rigid when the air therein is evacuated. Once the filler is distributed to make the bag fit the patient's form, the air evacuation process ensures that the shape of the bag is stabilized. Canadian Patent number 934,078 (Sakita) teaches essentially the same technique with some detail shown as to valving and screening to prevent evacuation of the filler material along with the air.

The United States patents, supra, do not teach or suggest that the inventions of those patents could be used to restrain and shape a structure used for support of the human body when in a relatively vertical or inclined position. Nor do they hint at a solution for the problem created by different body sizes which may exceed the range of capacity afforded by a single sized body support bag structure. The foreign patents do attack these problems, but by a relatively expensive method involving evacuation pumps, valves and screens. Furthermore, because of the need for evacuation pumps, those systems are not portable.

SUMMARY OF THE INVENTION

These and other problems and shortcomings of the prior art are resolved by the "bean bag" structure of the instant invention. A system of adjustable positionable seals are provided by means of a series of loop and hook strip fasteners located within or without the bag structure for adjustment of the size and shape of the bag. Additionally, cut shaped fabric baffles are provided within the bag structure to prevent all of the filler material from migrating to the bottom of the bag when subjected to gravitational forces.

It is, therefore, an object of the invention to structure a "bean Bag" support in such a way as to prevent movement of all of the filler material when the bag is inclined.

It is another object of the invention to provide a "bean bag" structure which has provisions built in for the purpose of changing the size and or shape of the bag to better adapt it to different sizes and shapes of the human body.

It is still another object of the invention to provide an adjustable support, for medical and or dental applications, which may be used to stabilize a variety of portions of the human body during medical or dental ministrations.

It is yet another of the invention to provide a "bean bag" structure which can be adjusted to fit various sizes and shapes of the human form for the purpose of providing creature comfort.

These and other objects of the invention will be more clearly understood by study of the Detailed Description of the Invention and of the drawings in which:

FIG. 1 illustrates, in perspective, an external view of a typical bag made according to the invention;

FIG. 2 is a cross-sectional view of the bag of the invention taken at 2–2 of FIG. 1;

FIG. 3 is a sectional view of the bag of the invention taken at 3—3 of FIG. 2;

FIG. 4 is a view of the bag of FIG. 1 as it appears with seals 24, 26 in the fastened state;

FIG. 5 illustrates the invention in full body sized form, as might be employed on a medical treatment chair;

DETAILED DESCRIPTION OF THE INVENTION

Figure 6:
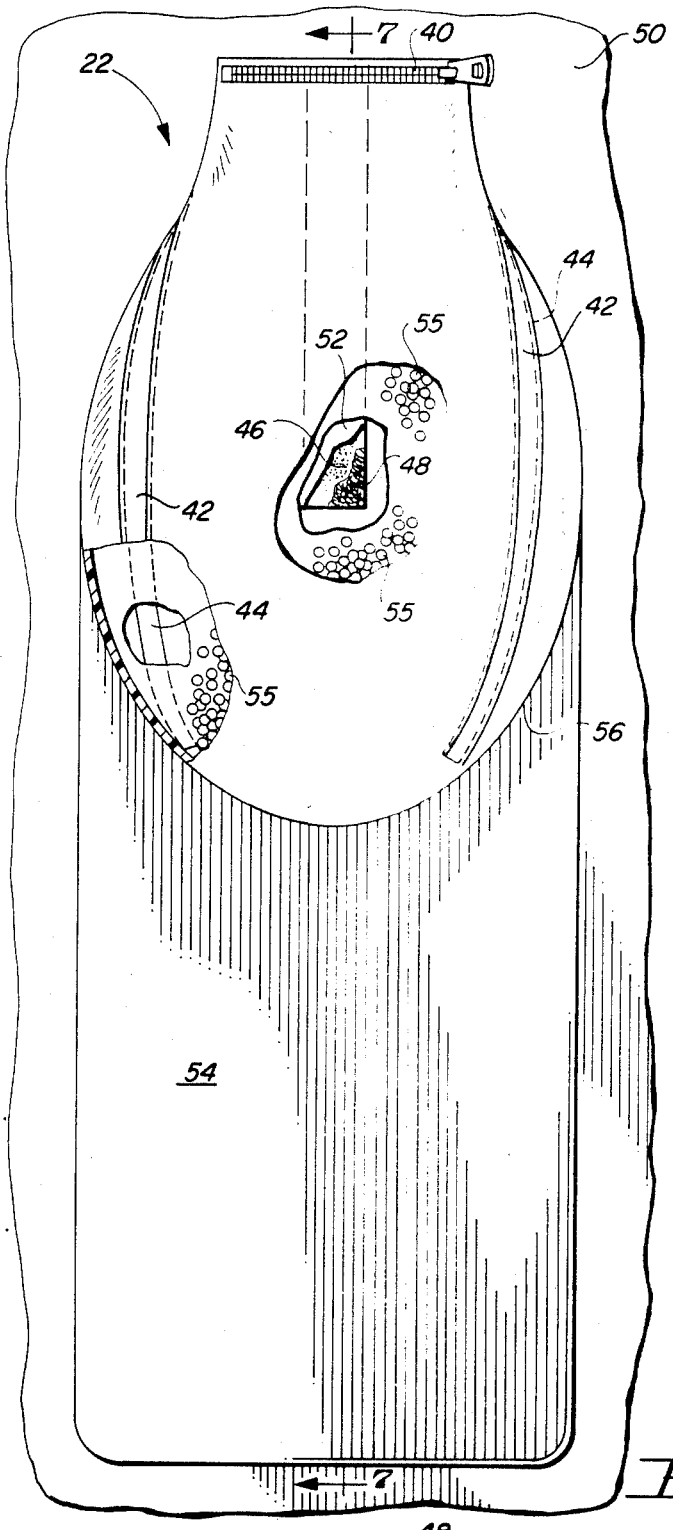
FIG. 6 illustrates a specific neck support bag intended for use in dental applications, incorporating an external fastener for changing the size of the bag.

The invention is basically an old fashioned bean bag but with some improvments for use in dental or medical use or in other uses where body comfort is important. The bag may be made small for use a dental patient's head (see FIGS. 6 and 7) or it may be made large enough to support the entire body of a patient (see FIG. 5). In any case, the purpose is to stabilize the position of the body or a part thereof and to provide for optimum comfort of the patient during dental or medical procedures. The body size bag may also be useful in medical cases where a patient's comfort may depend upon a close fitting support structure for the body or a part thereof. (For example; for body portion support on an x-ray table or surface. Note that the plastic filler material is transparent to x-ray radiation.) It is also possible that the bag (with the improvements described below) could be used for providing a high degree of body comfort in other applications, such as for in-home use for persons with spinal problems.

Problems with ordinary bean bag type structures used for these purposes include, (1) the inability to retain a sufficient number of beans (or more modern foam plastic filler pellets, or even still other filler materials) up high in a vertically oriented bag and, (2) an insufficient "fit" to the body because of large variations in body size and shape. That is, when an oversized bag is used to support the external forces exerted by a body or portion thereof, the filler material disperses and does not provide equal pressures on all cuved surfaces of that body portion, whether it be convex or concave, and fails to provide adequate support and/or comfort for that body or body part. While bean bag chairs provide good fit and the required support, they are relatively large. The two improvements described below are intended to overcome these problems by providing good support and comfort in presently used chairs.

In FIG. 1 it is shown that bag 22 is made of two half patterns, 10 and 12, joined by seam 14. The so enclosed portion is partially filled with suitable "beans" 18 (which are currently made of a foam plastic pellet material) in the conventional manner. (See FIG. 2.)

The first improvement to this age old design is the addition of sealing strips 24 and 26, which may be made of loop and hook fastening strips, each half of which is sewn or otherwise fastened in position on the inner side of half patterns 10 and 12, respectively. (One such loop and hook material is "Velcro" which is believed to be a trademark of Velcro U.S.A., Inc., Manchester, N.H. 03208.) They are positioned in such a way as to allow the loop and hook half strips to be sealed each to the other by applying slight pressure to bag 22 from the outside. (Typical internal positioning of the loop and hook strip halves is shown in FIG. 2 at 26.) The filler material can then be retained within a smaller envelope between sealing strips 24, 26, for those cases in which it is desirable to make the bag smaller and thicker.

Figure 7:
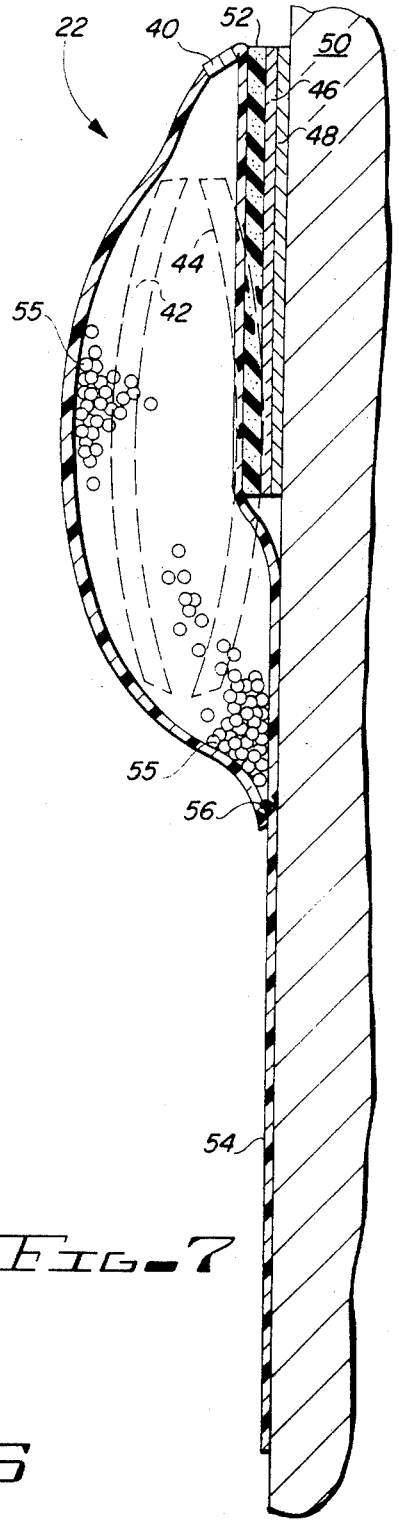
FIG. 7 is a sectional side view at 7—7 of the invention of FIG. 6.
Figure 8:
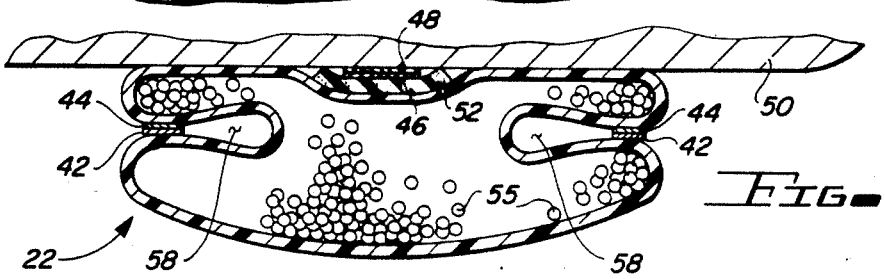
FIG. 8 is a cross-sectional view of FIG. 6, but illustrative of the fastening of strips 42,44.

It should be noted that while FIGS. 1–5 are illustrative of bags which have sealing means 24, 26 contained therein, it is preferable to put such sealing means on the exterior of the bag. This configuration is illustrated in FIGS. 6–8 and will be further discussed, infra.

It should be understood that it occasionally may be desirable to seal only one of the two pairs of strips 24, 26 for use when an intermediate sized bag 22 is needed. FIG. 4 illustrates an outer view of a typical bag 22 when both sealing strips 24, 26 are sealed. This is accomplished by holding the bag so that the sealing strips 24, 26 are oriented horizontally and then gently shaking the bag to urge the filler material toward the lower side. The sealing strip pair on the upper side is then caused to engage by applying external hand pressure along its length. The process is repeated, if necessary, by inverting and shaking the bag to urge the filler material against the strip which was just sealed and then applying hand pressure to seal the second pair of strips.

FIG. 2 is illustrative of the second improvement. Cups 20 are fastened by sewing or otherwise to the inner surfaces of either or both envelope pieces 10, 12. The open end of cups 20 are all oriented in one direction, which is defined as being toward the top of bag 22 as used. In use, filler materaial 18, within 16 bag 22 is urged to the top of bag 22 by inverting bag 22 and gently shaking it. When bag 22 is righted, cups 22 retain a quantity of filler material 18 so that it is not all allowed to run to the bottom of the bag when the force of gravity is applied. As the bag is compressed by the force of the weight of the user, the beans overflow cups 20 and distribute themselves locally to provide the optimum in comfort and support. Cups 22 are made of a relatively stiff material which tends to recover a cup shape when the external loads are removed therefrom. This assures that cups 22 are available to again retain filler material 18 when needed.

FIG. 3 is presented to better show one internal configuration of a typical bag 22. Of course, the patterns of cups 20 and fastener pairs 24 and 26 may be varied in number, position and size to suit a particular intended application of bag 22. Furthermore, the designed size of bag 22 may be varied for particular applications. There is really no limitation upon the number, size and placement of either the cups or sealing strips within any given bag design and it is expected that various configurations and combinations will evolve that are particularly suited to specific uses.

FIG. 5 illustrates an embodiment of the bag of the invention for use on a medical chair 32. Patient 28 is effectively supported over his whole body by proper design of the sealing strip position and use of them in the particular application together with careful design placement of internal cups (strips and cups not shown in this view). Bulgy sections of bag 22 shown between the legs of patient 28 at 30 and along his sides at 22A and 22B provide a high degree of comfort and support. This is made possible over a large range of patient body sizes because of the improvements provided by the invention. Of course, it will be understood that there are many variations on the bag designs shown here. For example, the bag of FIG. 5 may be foreshortened at the patient's waist or knee line. The bag may also be segmented by sewing horizontal seams therethrough at desired locations. Furthermore, some of the bag segments so produced may be equipped with cups and/or fastener pairs while other such sections may not be so equipped. One useful configuration may equip and upper section of the bag with both cups and fastener pairs down to a point corresponding to the patient's waist, place a permanent hoizontal seam at that point, and depend a conventional bag from that point down to a point corresponding to the patient's knee line. (This configuration is not illustrated but is provided as typical of alternative practical configurations. Many other practical applications of the invention may be utilized.) Another possible variation would eliminate the seam at the patient's waist line.

FIG. 6 is illustrative of a cervical or neck support bag according to the concepts of the invention. This preferred embodiment of the fastener pair aspects of the bag of the invention may be used for dental work or for other applications where head and neck support is important. As stated, supra, the configuration of FIG. 6 illustrates the use of externally located sealing strips 42,44. FIG. 8 shows how the excess fabric material of bag 22 of FIG. 6 is folded inwardly and sealing strips 42,44 are used to retain the extra material 58 in place, thus providing the same advantages of adaptable bag size as before stated. The external location of fastener pairs 42,44 provides an additional advantage in that filler material 18 cannot interfere with the sealing mechanism. The use of such externally mounted sealing or fastening pairs 42,44 is essentially the same as before described for interior mounted pairs 24,26.

Referring again to FIG. 6, it may be seen that zipper 40 or other such fastener is provided at the top of the bag to allow introduction of filler material 55. This also provides a means for emptying bag 22 when it is desired to launder or otherwise clean it. Mating sets of fastener pairs 42,44 are provided near the left and right perimeters of bag 22, one on each of the front sides and one on each of the rear sides making up each pair. Still another fastener strip 46 is located down the center of the back side of bag 22 for mating with the other half 48 of the pair which may be located on or near the center line of dental chair 50 (see FIG. 7), or the like, with which bag 22 is to be used. This allows the operator to position bag 22 on chair back 50 to suit the height of the patient. Soft foam strip 52 may be interspersed between bag 22 and fastener strip 46. If hook and loop fasteners are used, it is preferable to put the loop member on the front of bag 22, at 42, so that the hook member may not engage the patient's clothing.

FIG. 7 is also illustrative of an additional fabric section 54 which may be appended below a sewn or otherwise fastened seam at 56. This appended section 54 is used to stabilize the position of bag 22 on chair back 50.

FIG. 8 shows how the excess portions 58 of bag 22 (FIGS. 6–7) are turned inward and held in place by fastener pairs 42,44 in order to make bag 22 smaller and thicker. Note that there can be no interference caused by the filler material getting between the fastener pairs in this configuration. A further advantage of this configuration relates to the fact that because there is no such interference, the practical choice of fastener types is much enlarged. For example, snap fasteners become practical to employ in this configuration and they are much less expensive than hook and loop type fasteners. It would also be practical to use zipper type fasteners as well as many other types of fasteners.

While the invention has been particularly shown and described with reference to a preferred embodiment thereof, it will be understood by one having ordinary skill in the art that various other modifications and changes may be made to the present invention from the principles of the invention described herein without departing from the spirit and scope thereof, as encompassed in the accompanying claims. Therefore, it is intended in the appended claims to cover all such equivalent variations which do essentially the same thing in essentially the same way to produce the same result which come within the scope of the invention as described.

What is claimed is:

1. An improved bean bag structure, the bean bag comprising an envelope with filler material enclosed and contained therein, said filler material being free to migrate within the entire envelope, the improvement comprising:

a plurality of internal cup means for limiting migration of the filler material, each of said plurality of said internal cup means having an open end, each of said open ends of said internal cup means being oriented in a same direction.

2. The improved bean bag structure according to claim 1 wherein the bean bag structure further comprises:

fastener means for reducing a size of the bean bag.

* * * * *